US006347723B1

(12) United States Patent
Barlian et al.

(10) Patent No.: US 6,347,723 B1
(45) Date of Patent: Feb. 19, 2002

(54) METHOD AND SECURITY SYSTEM FOR SECURING A FLOWABLE GOOD

(75) Inventors: Reinhold A. Barlian, Bad Mergentheim; Alfred Böhm, Boehm, both of (DE)

(73) Assignee: BARTEC Componenten und Systeme GmbH, Bad Mergentheim (DE)

( * ) Notice: Subject to any disclaimer, the term of this patent is extended or adjusted under 35 U.S.C. 154(b) by 0 days.

(21) Appl. No.: 09/508,669

(22) PCT Filed: Sep. 22, 1998

(86) PCT No.: PCT/EP98/06031

§ 371 Date: Mar. 22, 2000

§ 102(e) Date: Mar. 22, 2000

(87) PCT Pub. No.: WO99/15458

PCT Pub. Date: Apr. 1, 1999

(30) Foreign Application Priority Data

Sep. 22, 1997 (DE) ..... 197 41 719
Nov. 17, 1997 (DE) ..... 197 50 950

(51) Int. Cl.[7] ..... B67D 5/33

(52) U.S. Cl. ..... 222/1; 141/231; 141/94; 222/544

(58) Field of Search ..... 141/94, 231, 346, 141/367, 198; 222/1, 23, 544, 545, 562

(56) References Cited

U.S. PATENT DOCUMENTS 4,934,419 A * 6/1990 Lamont et al. ..... 141/94
4,977,935 A * 12/1990 Durkee, Jr. et al. ..... 141/94
5,385,500 A * 1/1995 Dwars et al. ..... 141/94
5,507,326 A * 4/1996 Cadman et al. ..... 141/198
5,944,076 A * 8/1999 Palvoelgyi ..... 141/348

FOREIGN PATENT DOCUMENTS

DE 9411170 12/1994
DE 4431378 C1 9/1995
FR 2745531 9/1997

* cited by examiner

*Primary Examiner*—J. Casimer Jacyna
(74) *Attorney, Agent, or Firm*—Jacobson Holman, PLLC

(57) ABSTRACT

The invention relates to a security system for flowable products in storage and/or transportation tanks, which have openings at least for filling, removing and/or controlling purposes. The security system comprises a control device and write-read devices for data exchange with connection elements connectable to the openings. The connection elements have a code mark or a tag. With each opening is clearly associated a tag. With each opening is also associated a closure element as a connection element, on which is located the tag associated with the opening. The associations of tag and opening are controllable and storable in the control device and in the case of a specific association of all the tags with the particular openings a manipulation-free state can be displayed by the control device.

24 Claims, 5 Drawing Sheets

METHOD AND SECURITY SYSTEM FOR SECURING A FLOWABLE GOOD

BACKGROUND OF THE INVENTION

FIELD OF THE INVENTION

Figure 1:
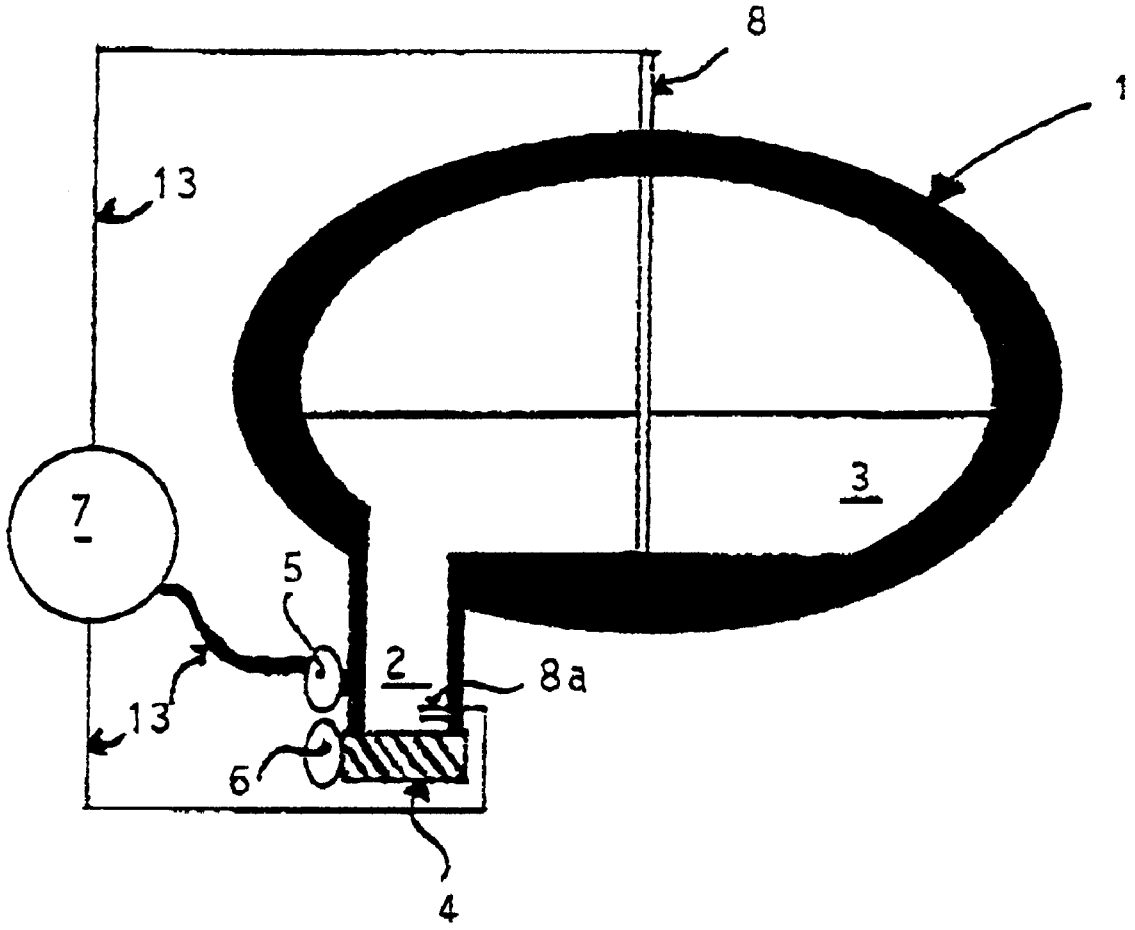

The invention relates to a method for securing a flowable product in a storage and/or transportation tank and to a security system for flowable products in storage and/or transportation tanks, which have openings at least for filling, removing and/or checking purposes, particularly for performing the method for securing a flowable product in a storage and/or transportation tank.

The invention relates to a method for securing a flowable product in a storage and/or transportation tank according to claim 1 and to a security system for flowable products in storage and/or transportation tanks according to the preamble of claim 4.

During the transportation of flowable or pourable products conventionally use is made of mobile containers, which are installed on vehicles. For example, tankers and their trailers are known. However, also rail vehicles, ships and aircraft are equipped with such transportation tanks or containers.

During the delivery or transportation of such products, particularly from a manufacturer to a customer, it is expected that transfer of the product to be delivered, e.g. from a storage container at one location to a customer container at another location, will take place without any changes to the composition or state of the load. Finally, the customer must also receive precisely the quality and quantity of product ordered.

However, it has been found that with conventional transportation containers, particularly those having conventional closure systems it is not possible to adequately ensure that during the transportation, as well as filling or unloading manipulations do not take place to the product to be transferred. This applies to substantially all liquids and gases to be transported, as well as to pourable materials such as granules, starch, powder (flour, sugar, etc.), feedstuffs, etc.

It must therefore be ensured e.g. for a wine transporter having a tank with several segments that the product ordered by the customer is filled in a filling location with a quality and quantity complying with the order of the customer. This means that e.g. there must be no contamination due to remaining residual quantities or impurities in the transportation tank. It must also be ensured that in each case the correct quantity of the correct wines are filled and not branched off.

During transportation interventions on the tank content must be prevented, so that the tank content quantity and quality are maintained in the form ordered by the customer.

On unloading the tank content into the customer container it must be ensured that once again there is no confusion and therefore contamination.

The prevention of the manipulation of a product transported in a tank during transportation, i.e. particularly after filling and prior to unloading, is only sensible if it can also be ensured that the product transported is also delivered at the correct consignee, i.e. to the intended destination tank. however, conversely it is also important that the consignee receives the product ordered by him, which presupposes that filling has taken place with the corresponding quantity and quality at a filling plant.

In the case of conventional transportation containers or those having conventional closures, all these problems can only be controlled, if at all, by considerable expenditure on additional personnel and additional measuring equipment, which leads to considerable security costs and therefore to product price rises.

SUMMARY OF THE INVENTION

The object of the invention is to provide a method and a security system with which flowable products can be made ready and/or transported in manipulation-proof manner in a container and can in particular be uninterruptedly monitored with respect to quality and quantity in a storage and/or transportation chain.

From the method standpoint this object is achieved by the inventive method for securing a flowable product in a storage and/or transportation tank, in which a control device and a write-read device are used for data exchange with connection elements connectable to the particular opening and which have a code mark or tag, with the following steps:

storing data with respect to the quantity and quality of the flowable product and/or unloading-relevant data, association of closure elements and tags with the associated openings of the storage or transportation tank and coding the association, checking whether the openings of the storage or transportation tank are correctly closed and closed with the closure element associated with the particular opening, use being made of the tag data read our with the write-read device, generating, storing and/or displaying an "UNSEALED" signal, if at least one opening is not correctly closed or not closed with the associated closure element and generating, storing and/or displaying a "SEALED" signal if in the existence of a predetermined filling state of the storage or transportation tank all the openings have been correctly closed within a predetermined time interval with the in each case associated closure element.

From the apparatus standpoint with a security system for flowable products in storage and/or transportation tanks, which have openings at least for filling, removal and/or control purposes, having at least one control device and a write-read device for data exchange with connection elements connectable to the particular opening. The system includes a tag associated with each opening, a closure element associated with each opening as a connection element and on which is located the tag associated with the opening. The association of tag and opening can be controlled and stored in the control device. Also, when there is a specific association of all the tags with the given openings, a manipulation-free state can be displayed by the control device. Advantageous further developments of the method and security systems according to the invention form the subject matter of subclaims.

In the security system for flowable goods in storage and/or transportation tanks according to the invention, with each tank opening from which product can be removed is associated in a particularly clear manner a code mark or tag.

In addition, with each opening is associated a closure element as a connecting element. On each closure element is applied a tag associated with the given opening. In the control device of the security system according to the invention it is possible to check and store the association between the tags and the openings. The control device of the security system according to the invention is constructed so that it indicates in the presence of a specific association of all tags with the given openings a manipulation-free state.

Thus, an essential idea of the present invention is that with each opening of the storage or transportation container is precisely associated a given closure element and that said closure element in each case has an identification device, e.g. in the form of a code mark or tag, which carries in it the association with the particular opening in the form of data.

A further essential idea of the present invention is that said data can be read by a write-read device of the associated opening. If the read data correspond to the association, i.e. the correct closure is located on the opening, this is established by the control device and consequently a signal is generated and/or represented which tells the user that the corresponding container opening is sealed and therefore manipulation-free. It is also essential for the association between the tags/closure elements and the openings to be checked and stored in the control device for comparing the actual state with the desired state.

The invention makes it possible to transfer pourable or flowable products from a container (A) at a given location (AA) to another container (B) at another location (BB) without any change to the load in the container or tank. Thus, e.g. unauthorized removals, content contaminations or state changes (e.g. temperature, etc.) are immediately noticeable, because a tank or container opening manipulation is indicated.

In a preferred embodiment of the security system according to the invention the control device is designed for generating, storing and/or displaying a "SEALED" signal, if within a given time interval after a correct filling indicated by filling data all the data read by the write-read devices coincide with the correct association of the tags with the particular openings. The control device is also designed for generating, storing and/or displaying an "UNSEALED" signal if data are not readable by the write-read devices or read data do not coincide with the correct association of the tags with the particular openings.

As a result of these precautions a sealed state is only generated and displayed by the system if both the filling coincides with the predetermined filling data and also following a correct filling all the openings have been correctly closed with the closure elements associated therewith, namely within a given time interval following the correct filling. Thus, if there is a "SEALED" signal, it can be assumed that the tank has been correctly filled and since filling there have been no manipulations with respect to the tank content.

If, however, an "UNSEALED" signal is generated and displayed, this means that at some time since correct tank filling a manipulation has taken place at the tank openings and/or that the tank was not correctly closed following the correct filling.

As a result of the inventive security system on a transportation tank it is ensured that in particular in the critical time period from leaving a loading or filling station up to the arrival at a target station there can be no manipulations of the transported product, i.e. no removal or modification to the content.

A further advantage is that e.g. a transportation vehicle has no need for an expensive and voluminous measuring system giving rise to additional weight so as to reduce the payload. This makes it possible to save volume and weight and ultimately also money, because the measuring system costs are avoided and the actual payload of the transportation vehicle can be increased. Moreover, during loading and unloading, there is no need to take account of a sensitive measuring system, which simplifies the corresponding method steps.

It is therefore possible to indicate or display without measuring expenditure that since a correct filling and "electronic" sealing in a refinery an opening must have occurred on a tanker delivering fuel to a filling station and the filling station owner or tenant can be warned by the "UNSEALED" status signal and can consequently refuse to accept the product whilst referring to this unsealed signal. This avoids any dispute concerning the correct filling and in particular concerning the quantity or nature of the product delivered.

Advantageously, in the system according to the invention all openings which can be potentially manipulated or through which access can be obtained to the container content are checked for their correct closure. For this purpose on all said openings are provided write-read devices or tag readers and corresponding closure elements with associated tags.

Advantageously the write-read devices are constructed as substantially identical write-read wands or so-called tag readers. Hereinafter the terms write-read device, communications device, write-read wand and tag reader are used synonymously. Correspondingly a tag can also be looked upon and called an identification or code mark or in general an identification device.

For implementing the monitoring function of the security system according to the invention the control device is designed for the reception of tag data, particularly via the tag readers. In addition, the control device is also used for receiving, time logging, evaluating and/or displaying the data received.

It is consequently possible with the security system according to the invention to precisely log the time pattern of the state and the status of the storage and transportation container and subsequently analyze the same, e.g. in the case of a malfunction or an illegal intervention.

It is also advantageous in this connection for the control device to be constructed with optionally connected hoses or tubes for receiving data. These hoses or tubes, which are connected to the container openings are more particularly used for filling, emptying and/or compensation and must for this purpose have corresponding data transmission devices, e.g. lines to a host computer or identification devices or tags.

Apart from identification data, it is also possible for an interchange of further data with the control device by means of the tag readers and they are recorded, stored and evaluated by it. These further data can describe the filling and/or emptying and/or contain further loading and unloading-relevant data concerning the storage and transportation container and/or the filling or unloading station. The data can e.g. represent the fill level, quantity and nature of the filling, temperature, tank number, sender/producer, etc.

In addition, the control device is designed so as to receive data from measuring sensors which may be provided and to check whether they are within the preset desired data. As a result the control device can detect e.g. danger situations. This e.g. applies to the monitoring of the temperature in the case of flammable products.

All data, both from the connected hoses or tubes and also the measuring sensors provided, are advantageously received by the control device, time-logged, evaluated and/or displayed, so that it is subsequently possible to prove an incorrect operation, a malfunction or an illegal intervention on the container.

In a preferred embodiment of the security system according to the invention this takes place by means of the tag readers and namely before, during and/or after loading and unloading processes. This makes it possible to ensure that there is an uninterrupted logging and monitoring of the status of the container and its content in the form of a closed monitoring chain.

According to another advantageous further development of the inventive security system for the data exchange of loading and/or unloading-relevant data, such as e.g. product quality, quantity, temperature, etc. is constructed with a loading or unloading station or the like.

Thus, e.g. in a type of handshake process with a loading or unloading station it is ensured that a so-called quality assurance is inherent in the security system. Thus, via the communication with the loading and unloading station it can be ensured that always the correct connections are interconnected. This prevents incorrect loads, undesired mixtures, the supply of incorrect quantities, etc.

It is advantageous and provided that in the control device of the inventive security system are predeterminable loading and/or unloading-relevant data in the form of desired data.

The control device only generates a loading and unloading release or enable signal if the predetermined (desired) data are compatible with the exchanged data of a loading and/or unloading station. This ensures the aforementioned quality assurance principle during loading and unloading.

In addition, an improvement to the security aspect is achieved in that an authorization device is provided through which at least authorization data can be read into the control device. The control device can enable or inhibit a change of data contained therein on the basis of authorization data.

As a result of this measure only an authorized person. e.g. also the customer or the filling station owner, can modify the state of the control device, e.g. with respect to the desired data for filling and unloading.

Said authorization device can e.g. be constructed in the form of a tag reader, which is connected to the control device and to which the authorized person can couple and read out a specific tag. The control device then decides whether the read in authorization data are adequate for a modification of the data stored in the control device.

Increased security can also be achieved in that over and beyond the authorization by means of the tag/tag reader combination a password or PIN can be interrogated in updated manner. This more particularly applies to the securing by the PIN/password on the truck park manager plane. The authorization device can also be used for acknowledging and/or releasing the loading or filling.

Preferably the control device is constructed for the continuous and repeating reading out of all tag readers and/or the associated tags. This ensures that e.g. the time of any manipulation which occurs at at least one of the closures can be logged.

It can e.g. be the case that at a readout time a particular closure is unsealed and that at the next readout time conditions for generating an unsealed signal no longer exist, because in the meantime the closure has again been correctly fitted. This is recorded by the security system according to the invention.

In an embodiment the continuous readout can be implemented by the control device either sequentially or as a parallel readout of tag readers. The randomized sequential readout of the tag readers is particularly effective with regards to the security aspect because a plurality of openings are checked with regards to their status in a previously not established sequence. This makes much more difficult even brief access to the openings of the container by unauthorized third parties.

For implementing the repeated, continuous readout of the tag readers, according to a preferred embodiment a timer is provided, which generates and supplies a readout cycle and consequently defines the time sequence of the container status check.

The data are in particular transmitted in wireless manner between the write-read device/tag reader of the opening and the particular closure. For this purpose the data are interchanged between the tag reader and a tag by means of electromagnetic waves, particularly by electromagnetic induction. In addition, the optical exchange in both the visible and infrared radiation range is advantageous. Consideration can also be given to an acoustic transmission, particularly based on ultrasonics.

It is possible to supply the tags and/or tag reader from an external, particularly a central energy source. However, it is particularly advantageous to provide decentralized energy sources for the operation of the tags and/or tag readers. These can e.g. be corresponding batteries, accumulators or also solar cells, which are installed in the vicinity of the particular container openings or are constructed directly in the tag reader and/or in the tag. The use of several decentralized energy sources increases the operational reliability of the complete system and also ensures that operation occurs, when e.g. a truck tow vehicle is missing.

The system according to the invention is particularly simple if the tags are designed as transponders. This leads to the reading of the tags being initiated by the associated write-read device/tag reader. This e.g. takes place in that the tag reader emits an electromagnetic wave, which is received by the associated transponder, e.g. the associated closure tag and responds with emission of e.g. a corresponding identification code.

It can in particular be provided that the electromagnetic wave is transmitted by induction from the tag reader to the tag, the transmitted electromagnetic wave also being used for transmitting the operating energy for the transponder. Thus, in this case the transponder receives the electromagnetic wave, e.g. by induction and the received energy is used to transmit back a corresponding identification signal.

It is also advantageous if the identification device is constituted by a so-called tag or transponder emulator or a tag or transponder simulator.

Such an emulator or simulator behaves in the same way as a tag or transponder, i.e. the emulator or simulator answers and reacts only to an interrogating signal of a corresponding reader.

Otherwise the internal structure of the transponder emulator or simulator can be very complex and e.g. contain various memory components and microprocessors. This has the advantage that compared with a conventional transponder it is possible to store and/or transmit a larger data quantity. It is also possible with an emulator or simulator to modify the identification data contained, which can take place by external action or also by a control device contained in the emulator or simulator. A multipath data communication is also possible with an emulator or simulator.

In addition, tag simulators are write-read wands or tag readers which read and write normal tags, but behave as if they would also read the contents of other, additional, tags.

For this purpose another computer, e.g. located in the loading and/or unloading station, can feed or play in variable data of the particular station or any other data into the tag simulators, so that said additional data can e.g. be transmitted by means of the tag readers of the tank openings to the on-board computer of a tanker.

The situation is also such with the tag emulators that they behave like a tag, but in reality e.g. have an on-line connection to a host computer. Thus, once again a continuous data communication is possible between the vehicle (transportation tank) and a loading and/or unloading station. It is also possible to install both on the vehicle or transportation tank and at the loading and/or unloading station tag emulators, so that it is possible to exchange larger data quantities between the particular computers.

An on-wire data exchange can be used for data communication between the control device and the tag readers. However, it is advantageous in specific cases to provide a wireless transmission of data between the tag reader and the control device.

Wireless data transmission is particularly advantageous under rough refinery or filling station operating conditions, because here frequently great care would be necessary in order not to damage the corresponding data lines on the tanker. Specifically for the case of an existing tanker being retrofitted with a corresponding system for checking the status of the tank, wireless communication between the tag readers and the control device is particularly appropriate, because during retrofitting often lines are only possible in the outer region of the tanker and consequently the lines cannot be concealed and protected.

An advantageous variant of the on-wire communication between the tag readers and the control device takes place by means of a serial or parallel data line. It is possible to use conventional bus procedures, particularly based on the RS 485 standard. In principle any transmission protocol and any bus system are possible, which permit a serial or parallel communication between the control device and the corresponding write-read devices.

For a very rapid readout of the plurality of tag readers by the control device, which can be designed as a central microcomputer unit, it is also advantageous to have and operate an interface or a multiplexer system, which switches backwards and forwards in rapid tire sequence between the individual data reception and transmission fines.

The tags of the container openings, particularly the transponders or identification marks (tags), advantageously have digital storage means containing the identification data to be generated and emitted. The storage means can be readable or readable/writable.

It is advantageous to construct the storage means as EEPROMs or the like. However, in principle any read or write-read memory can be used. This provides a particularly flexible possibility for the coding and recoding of the tags.

The use of such memory components and/or the aforementioned bus procedures for the data communication lines between the tag readers and the control device provides the possibility of a safe operation of the security system, particularly in very sensitive, dangerous or explosive areas.

Conventional electrical devices, particularly for tankers for flammable materials and fuels, require special safety measures, e.g. for avoiding high electric currents or sparks. However, the system according to the invention operates in a current-voltage range excluding spark formation and transfer. Thus, use is also possible in connection with flammable products or areas with an explosion hazard.

The tags are advantageously activated by a tag reader related to the particular associated opening of the storage or transportation container.

Activation more particularly takes place for the provision of an identification signal characteristic of the particular closure. As stated hereinbefore, said identification signal can be implemented by a corresponding, at least readable storage device.

In principle, activation of the identification device is also possible through further write-read devices or tag readers e.g. in order to be able to modify the particular identification code following operator authorization. The memory contents of the container opening closure tags can also include data extending beyond a pure identification between opening and closure. Said further data can also be read in or written into the corresponding memory components from the outside following authorization and activation.

As measuring sensors are conceivable and provided level sensors, which can e.g. measure the gravity force at the bottom of the container or container compartments. In addition, with liquids so-called dip sticks can be provided.

According to another advantageous development of the inventive system at least one discharge and/or feed valve is provided, which can be controlled by the control device.

On the basis of the filling data of the storage and transportation container and on the basis of status data with respect to the container openings and their closures, the control device can e.g. prevent the opening of a feed valve, if e.g. one of the tank openings is not closed. In addition, the control device can inhibit the feed valve during filling if a particular fill level is reached and an overflow threatens.

Hoses or tubes connected to the openings can inform the container control device through their tags and via the corresponding container opening tag readers which filling or which type of emptying is to take place. If said filling or emptying data do not coincide e.g. with the desired data preset in the control device this can either be indicated in the reverse direction, i.e. from the container control device via the tag readers of the openings and the connected tubes or hoses to the emitting or receiving unit and/or the control device itself inhibits the corresponding feed and/or discharge valves at the container.

Thus, with the security system according to the invention there is implicitly and automatically a quality assurance system, as is required and necessary in the field of vehicle fuels, as well as in other fields with respect to tilling hose security and protection against mixing.

A particularly efficient quality assurance system can be implemented with the system according to the invention in that the control device is equipped for data exchange purposes with an external control device.

This external control device can e.g. be constructed in a filling station or also in a discharge station to be supplied. Data exchange is implemented by means of hoses and/or tubes connected to the container openings and/or via an additionally provided on-wire or wireless data section, e.g. by radio, infrared or ultrasonics.

Consideration can also be given to making the hoses conductive and to transmit using the magnetic inductive coupler principle or by means of an additional line the data in question and then at the ends of the hoses or tubes or on their flanges are provided corresponding communications devices in the form of read devices, write-read devices or tag readers.

Data transmission via the hose or tube can advantageously be obviated if the association of the corresponding connections is ensured e.g. via identical or pairwise associated, coded transponders or tags on the particular hose or tube ends.

According to the invention the security system is used on fixed and mobile storage and transportation containers, which can e.g. be underground bunkers or tanks. Consideration can also be given to a container incorporated into a corresponding production or further processing installation. The storage or transportation containers can be designed for a gas, liquid, gel, powder, etc. Consideration can also be given to corresponding mixtures. Particular reference is made to use in connection with tankers for fuels, water, milk, wine, beer, fruit juices, etc., as well as flour, sugar, feedstuffs, etc.

In general, the system according to the invention can be used in all containers, also in retrofitting processes, in which a substantially pourable or flowable product is to be received and/or transported.

In the inventive method for securing a flowable product in a storage and/or transportation tank data are stored in connection with the quantity and quality of the flowable product and/or loading and/or unloading-relevant data. Closure elements are associated with the relevant openings of the storage or transportation tank and the association is coded. In the method according to the invention a check is made as to whether the opening of the storage or transportation tank have been correctly closed with the closure element associated with the particular opening.

In addition, an "UNSEALED" signal is generated, stored and/or displayed, if at least one opening is not closed with the associated closure element or not correctly closed. A "SEALED" signal is generated, stored and/or displayed, if when there is a predetermined filling state of the storage or transportation tank all the openings within a predetermined time interval have been correctly closed with the particular associated closure element.

Preferably the actual filling state of the storage and transportation tank is determined with regards to the quality and quality of the flowable product in the tank. The actual filling state of the storage and transportation tank is compared with the predetermined filling state and a "SEALED" signal is at the most generated only if the actual filling state corresponds with the predetermined filling state. Thus, even if all the openings of the storage and transportation tank are correctly closed, an electronic seal can only be generated if the actual filling of the tank corresponds to the desired, predetermined tank filling.

In addition, the openings of the storage or transportation tank are repeatedly, successively and/or simultaneously checked in a given order or in random manner. Thus, a check on the status of the openings of the container and its content can be monitored and observed with respect to its time evolution.

In particular, the openings are monitored before, during and after a transportation, loading and/or unloading process.

Before, during and after a loading and/or unloading process loading and/or unloading-relevant data are interchanged with the loading and/or unloading station.

This provides a high level of security, because as a result it can be ensured that the quantity of a specific product desired by a customer actually reaches the consignee. Confusion and mixing, as well as contamination are consequently excluded.

Filling and/or unloading-relevant data are constituted by those relating to the filling type, filling quantity, manufacturer, filler, consignee, temperature, tank number, empty state, residual volume, route, driver and/or the like.

For achieving a maximum level of security it is possible for a loading and/or unloading of the storage and transportation tank only to be permitted in the method according to the invention if predetermined loading and/or unloading-relevant data are compatible with and coincide with the data of the intended loading and/or unloading station.

The method according to the invention ensures that the state of the tank openings and tank content are uninterruptedly logged, monitored and secured against manipulation in the form of a closed chain from the time of filling, via transportation and up to the unloading.

The invention is described in greater detail hereinafter relative to a preferred embodiment and the attached diagrammatic drawings, wherein show:

FIG. 1 A diagrammatic, part sectional side view of the security system according to the invention.

Figure 2:
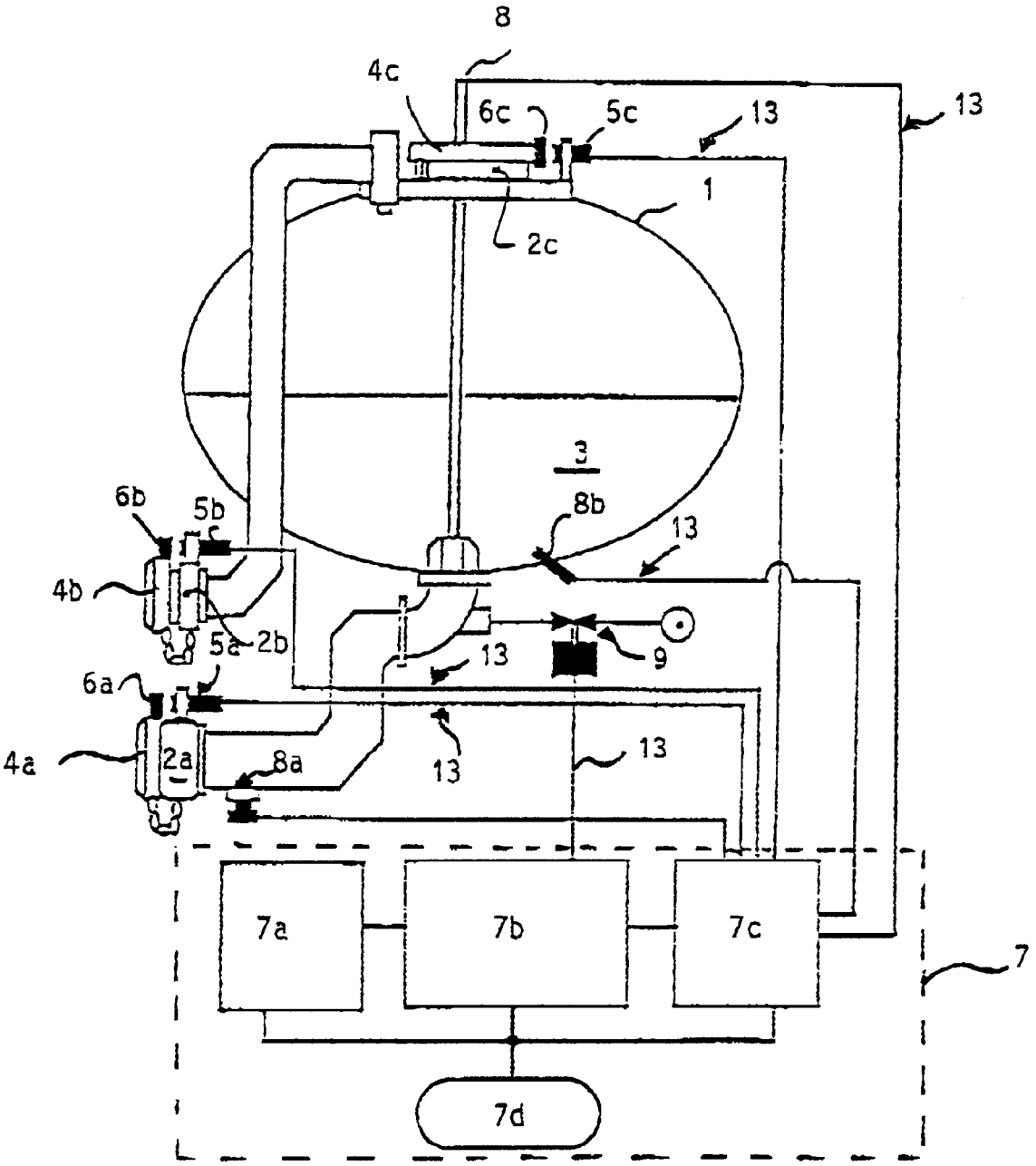

FIG. 2 A first embodiment of the security system according to the invention in a diagrammatic, part sectional side view.

Figure 3:
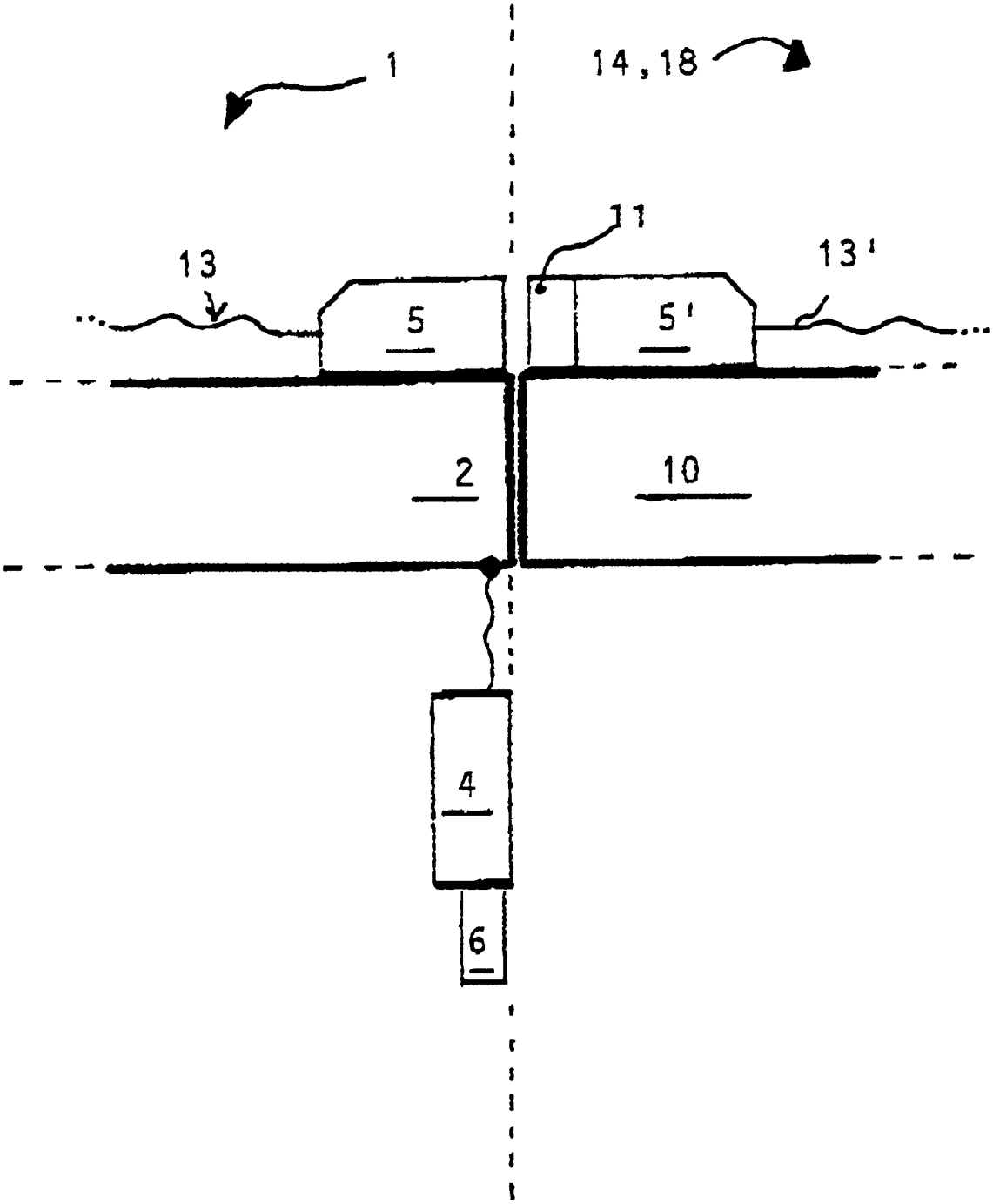

FIG. 3 A diagrammatic side view of a further embodiment of the inventive security system in the vicinity of a tank opening.

Figure 4:
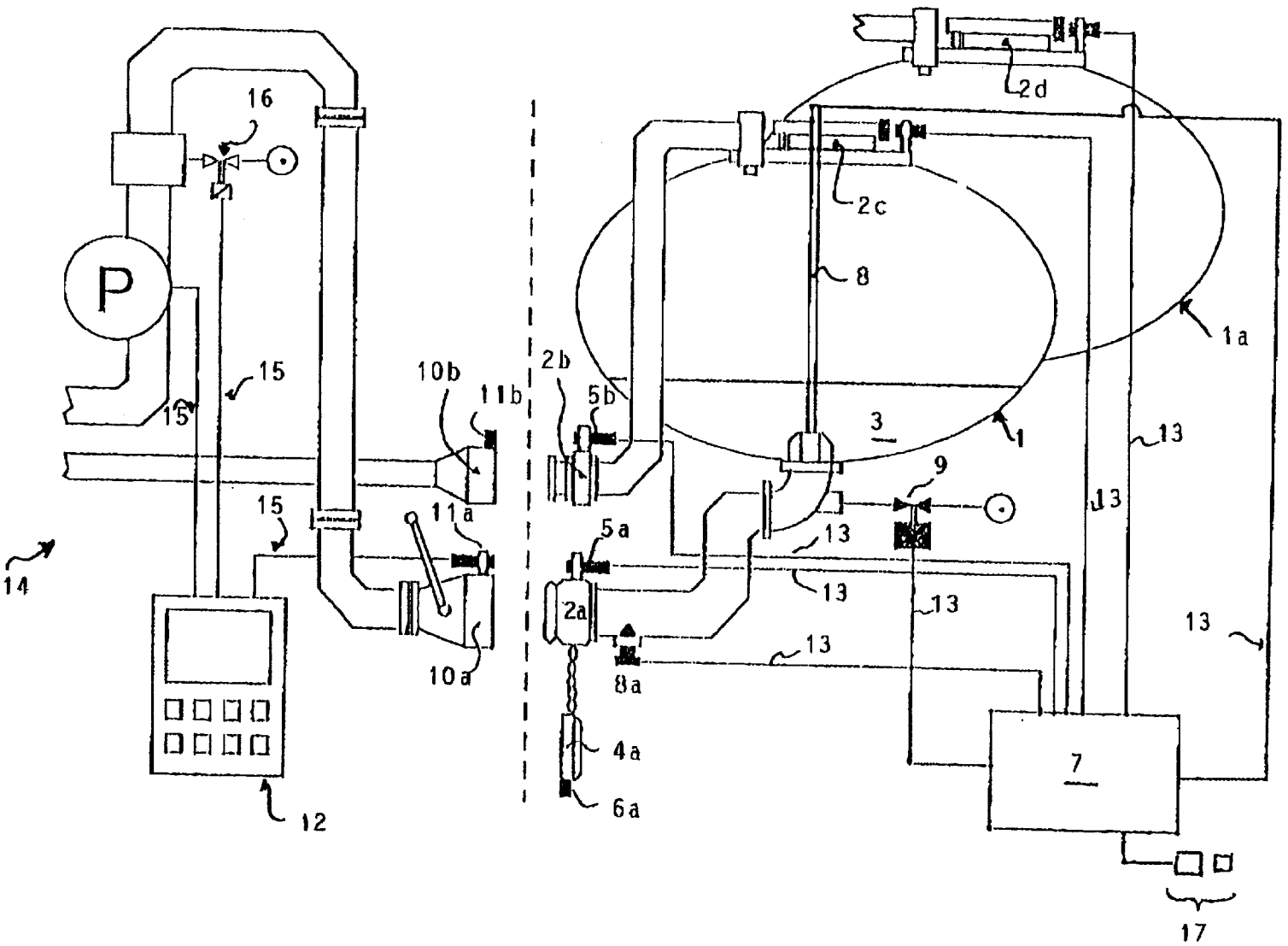

FIG. 4 A diagrammatic, part sectional side view of an embodiment of the inventive security system during the filling of a storage and transportation tank.

Figure 5:
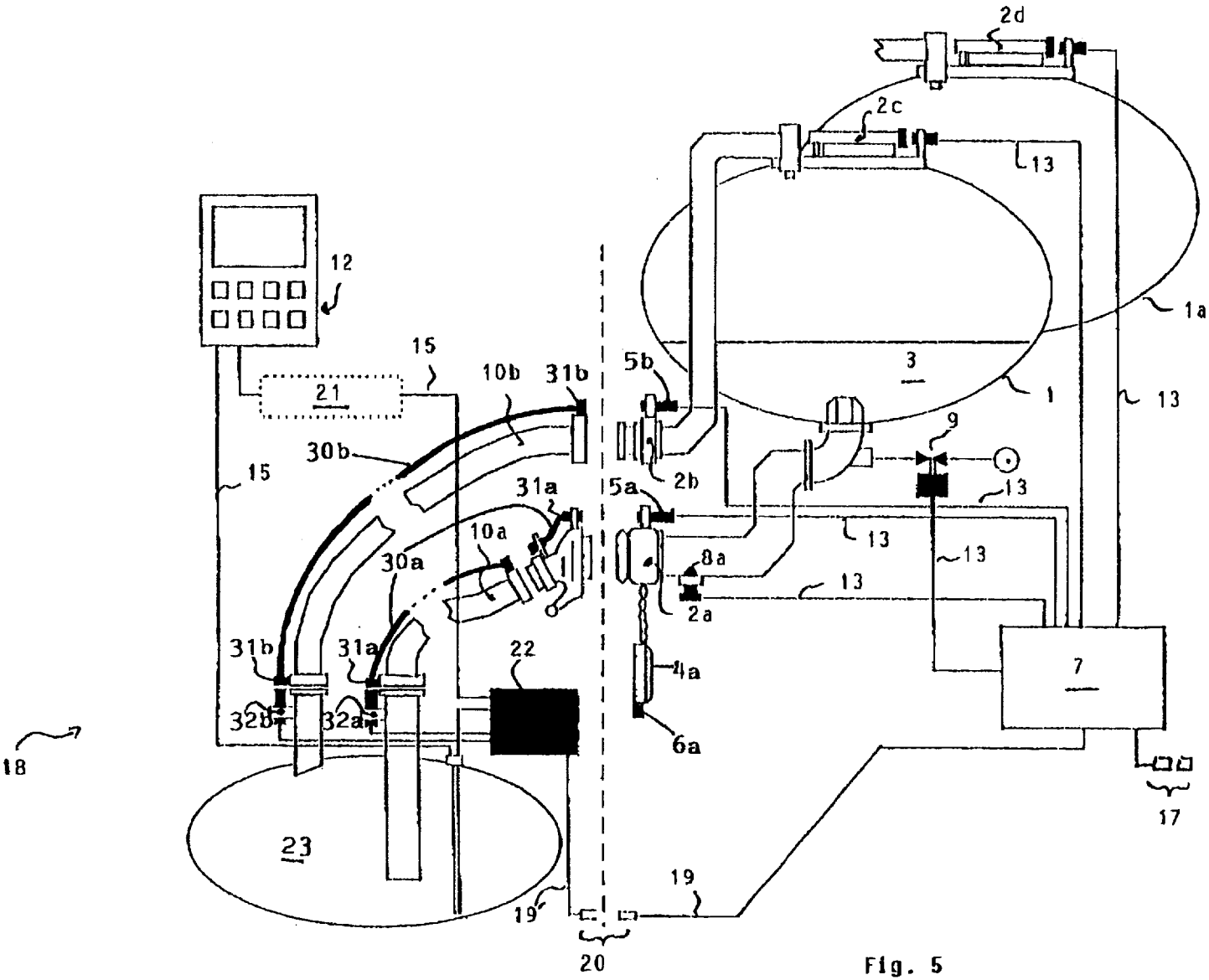

FIG. 5 A diagrammatic, part sectional side view of an embodiment of the inventive security system on unloading a storage and transportation tank.

DESCRIPTION OF THE INVENTION

FIG. 1 shows in a diagrammatic, part sectional side view an embodiment of the security system according to the invention.

The container 1 is provided with an opening 2, which is closed by a closure 4, here in the form of a cover. The opening 2 has a tag reader 5 by means of which a tag 6 or a data carrier 6 of the closure element 4 of the opening 2 of the container 1 can be activated, read out and interrogated by means of a control device 7.

Measuring sensors 8 and 8*a* are also provided, the sensor 8 measuring in the form of a dip stick the fill level of the product 3 in the container 1 and the sensor 8*a* being possibly a residual quantity or empty indication sensor or also a temperature sensor. The sensors 8, 8*a* and tag reader 5 of the system are connected by communications and/or supply lines 13 to the control device 7.

FIG. 2 shows diagrammatically and in a part sectional side view an embodiment of the security system according to the invention.

The container 1 has a filling and/or unloading opening 2*a* with an associated closure 4*a,* which carries an identification device 6*a* in the form of an identification mark, transponder or tag, which in turn can be read out by means of a tag reader 5*a* of the opening 2*a* and whose data can be passed on by means of a data line 13 to the control device 7.

The opening 2*b* for gas compensation and the opening 2*c* for the dome cover of the container 1, which is here represented in the form of a tank 1 installed on a tanker, have corresponding closures 4*b,* 4*c* with tags 6, 6*c* readable by means of the tag readers 5*b,* 5*c* of the openings 2*b,* 2*c.* By means of data lines 13 measuring sensors 8, 8*a* and 8*b* for measuring the fill level, empty state or residual quantity or temperature are connected to the control device 7. in addition, a feed and/or discharge valve 9 is connected by means of a data and/or supply line 13 to the control device 7.

The control device 7 has as components a current/voltage supply 7*d,* an interface device 7*c,* optionally with multiplexers, a valve interface 7*b* and the central control and evaluating unit 7*a,* i.e. the controller. The control device 7 can in principle be implemented as a microcomputer with corresponding data input and output possibilities.

FIG. 3 shows in a diagrammatic side view an embodiment of the inventive security system in a storage or transportation container 1, in which to a container opening 2 is connected a tube 10 of a filling or discharging station 14 or 18 for filling or unloading the tank 1.

The opening 2 of the tank 1 has associated with it a closure element 4 in the form of a cover 4. The closure element or cover 4 has a tag 6, which in the correctly closed state of the opening 2 can be activated and read out by the tag reader 5 of the opening 2, the data of the tag 6 being forwarded by means of the evaluating and supply line 13 to the here not shown control device 7 and are evaluated by the latter. The connection 10, here in the form of a tube or hose 10 of the filling or unloading station 14, 18, also has a tag 11, which can be written or read by means of a write-read device 5' located in the vicinity of the tube 10.

In this embodiment the tag 11 of the tube 10 can be read and written in both directions, i.e. on the container side data can be impressed on the tag 11 of the tube 10 by means of the line 13 and the tag reader 5. Subsequently said data can be forwarded by means of the tag reader 5' of the tube 10 e.g. to a host computer of the filling or unloading station 14, 18 by means of a corresponding supply or evaluating line 13'.

A reverse data transfer from the filling or unloading station 14, 18 to the storage or transportation tank 1 or to a corresponding on-board computer 7 is also possible. For this purpose by means of the line 13' of tube 10 data are impressed in tag 11 by means of the tag reader 5' of the tube 10 and are then read out from the tag reader 5 of the opening 2 of container 1 and forwarded by means of the data line 13 to the control device 7 or to the on-board computer 7 for evaluation purposes.

FIG. 4 shows in a diagrammatic, part sectional side view the filling process in the case of a tank 1 using the security system according to the invention.

To the opening 2*a* of the container 1 is flanged a filling tube 10*a* with a corresponding, matching nozzle, following the removal of the closure 4*a* of opening 2*a* and consequently by means of the communications device 5*a,* via a data line 13 the central interrogation and control device 7 is informed of the lack of the closure. Thus, through the analysis by means of the interrogation and control device 7, on filling the container 1 has the "UNSEALED" state.

The opening 2*b* for gas compensation is connected to the gas compensation tube 10*b* of the filling station 14, so that the residual fuel displaced from the compartment 1 by the inflowing filling product 3 is received and returned in accordance with the environment protection conditions prescribed. The filling station 14 is controlled by means of a central control device 12. By means of data lines 15 a pump P and valve means 16 are controllably provided.

During the filling process the dome cover openings 2*c,* 2*d* of compartments 1, 1*a* are generally closed.

Operator authorization takes place by means of an operator tag 17 when the tanker drives onto the filling platform. Filling is then programmed by means of a filling menu to be selected at the control device 12 of the filling installation 14.

Following the opening of the cover the filling hoses or tubes 10*a* or the compensating tubes 10*b* are connected to the opening 2*a* or 2*b* of compartments 1, 1*a*. As a function of the preselected quantity and filling start control, fillings of the individual compartments 1, 1*a,* etc. are started at the depot computer 12. Following the filling of compartments 1, 1*a* the filling hoses 10*a* and gas compensating hoses 10*b* are released from the openings 2*a* and 2*b*. The closures 4*a* and 4*b* are correctly fixed on the openings 2*a* and 2*b*. If this takes place within at intended time interval following the end of the filling process, an automatic sealing of the compartments 1, 1*a,* etc. takes place. At the end of the correct filling process the tanker drives down from the filling platform.

The flanges of the filling tubes 10*a* or gas compensating tubes 10*b* additionally have their own identification devices or code carriers or tags 11*a* or 11*b,* which are connected by means of data lines 15 to the depot computer 12 of the filling station 14.

After corresponding authorization by means of the tags 17 at the tanker on-board computer 7 a filling only takes place if the filling data preset in said computer 7 and which are forwarded to the communications devices 5*a,* 5*b* of the openings 2*a,* 2*b,* coincide with the filling data contained in the depot computer 12 of the filling station 14. The communication, i.e. the data exchange, takes place on the tanker side by means of the corresponding connections of the communications devices 5*a* and 11*a* on the filling station side.

Following the connection of the filling hoses 10*a* there is consequently a data exchange between the depot 14 and the tanker. The product identification and the associated compartment 1 or 1*a* are matched. The permitted filling quantity for the compartment 1, 1*a* and, in certain circumstances by means of a sensor 8 or 8*a,* any residual quantity in the compartment 1, 1*a* is established. If the exchanged data are compatible with one another, then the tanker on-board computer 7 by means of a data line 13 opens the feed valve 9. By means of the data communication between the on-board computer 7 and the depot computer 12 the start of the filling operation is initiated. By means of a data line 15 the depot computer 12 starts up the pump P after the discharge valve 16 has been opened by another data line 13.

These measures ensure that the correct product is filled in the intended quantity into the particular compartment provided. The mixing hazard is excluded, because as a result of the residual quantity sensor 8, 8*a* it is ensured that if a residual quantity is present it is only possible to introduce the same product and another product can only be introduced if the tank 1, 1*a* has been completely emptied.

FIG. 5 shows in a diagrammatic, part sectional side view the unloading of the system shown in FIG. 5.

There is a substantial communication between the tanker on-board computer 7 and the depot computer 12 of the filling station 18. By means of a data section 19, 19', 20 the corresponding data with respect to the products type, product quantity, available volume in the tank 23 and further data are interchanged. The data section 19, 19', 20 can be purely on-wire involving corresponding data buses 19, 19' with an interface 20. However, consideration is also given here to a radio connection or an ultrasonic or infrared radiation connection and then data transfer to the location 20 is implemented by means of corresponding transmitters and receivers.

On driving into the filling station operator authorization takes place at the tanker on-board computer 7 by means of an authorization tag 17. Following the opening of the cover, if a sealed load is present, the corresponding connections of the hoses 10*a,* 10*b* are made for the acceptance of the product or for gas compensation at the openings 2*a,* 2*b*.

Data exchange between the filling station and the tanker is started with respect to tank identification, product identification, gauge level interrogation, etc. Only if all the data are compatible is the discharge valve 9 opened by the tanker on-board computer 7 and also any feed valve provided at the filling station 18.

After filling the tanks, with in certain circumstances a monitoring of a complete compartment emptying, the hoses or tubes 10*a,* 10*b* are removed from the tanker openings 2*a,* 2*b* and the covers 4*a,* 4*b* are correctly fitted, the tanker being once again automatically "electronically" sealed with respect to the corresponding compartments.

For increasing security there can be a so-called battery buffering, so that in the case of corresponding tanks, e.g. in tankers parked overnight in parking locations or in a warehouse, with uncoupled semitrailers or unconnected battery, the arrangement according to the invention remains active for checking the container status and for consequently recording any manipulation to the container.

Such a maintaining active of the system, e.g. by battery buffering can naturally only be implemented for a predetermined, limited time, e.g. typically three days. If it is not possible to maintain the power supply, the system automatically passes into a fault state and stores as the final state "UNSEALED". Following the coupling of an intact power supply only the authorized truck park manager can restart the system and after checking the tank contents possibly return same to a "SEALED" state.

In the embodiment according to FIG. 5 the communication between the tank-side control device 7 and the control device 12 of the unloading station 18, particularly with respect to the robust loading and unloading operation, can be simplified in that in place of an additional and expressly present, on-line transmission system 19, 19' and 20 by means of the connected tubes and hoses 10*a,* 10*b* are constructed so-called inductive couplers for the data exchange between the control devices 7 and 12 or between the control device 7 and station-side provided tags 32*a* and 32*b.*

In this case e.g. at the filling or gas compensating nozzle of the tank 23 of the unloading station 18 there is only one tag 32*a* or 32*b,* which can optionally be read out or written by means of inductive couplers 31*a* or 31*b,* optionally with lines 30*a* and 30*b.* In place of a tag it would naturally also be possible to use tag simulators or emulators.

As a result of the security system and method according to the invention it is also possible to achieve in a particularly simple and reliable manner and also check the loading and unloading of corresponding products in the absence of operating personnel at the loading and/or unloading station, i.e. during night or phantom operation.

Obviously with respect to the display of a "SEALED" or "UNSEALED" state, the security system or method according to the invention is not only relative to a tank or transportation container as a whole. Instead, in the case of a tank having several compartments, a sealing and/or unsealing state can be individually produced and/or displayed for each compartment. Thus, a compartment of a tank or container is to be looked upon as a storage or transportation tank or container.

It is also pointed out that the security system and method according to the invention can also be used on holds and containers, where it is a question of security and monitoring the corresponding cargo hatches or container doors for undesired access. Such holds or containers can naturally also contain, in addition to solid goods, piece goods or also cartons or other containers as their load.

We claim:

1. A method for securing a flowable product in a storage and/or transportation tank, in which a control device and a write-read device are used for data exchange with connection elements connectable to the particular opening and which have a code mark or tag, with the following steps:

storing data with respect to the quantity and quality of the flowable product and/or unloading-relevant data, associating closure elements and tags with the particular openings of the storage or transportation tank and coding the association, checking whether the openings of the storage or transportation tank are correctly closed and closed with the closure element associated with the particular opening, use being made of the tag data read or with the write-read device, generating, storing and/or displaying an "UNSEALED" signal, if at least one opening is incorrectly closed or left opened with the associated closure element and generating, storing and/or displaying a "SEALED" signal if in the existence of a predetermined filling state of the storage or transportation tank all the openings have been correctly closed within a predetermined time interval with the in each case associated closure element.

2. The method according to claim 1, further comprising the steps of:

determining the actual filling state of the storage and transportation tank with respect to the quantity and quality of the flowable product comparing the actual filling state with the predetermined filling state, and generating a "SEALED" signal only if the actual filling state coincides with the predetermined filling state.

3. The method according to claim 1, further comprising the steps of:

repeatedly checking the openings of the storage and transportation tank in a successive and/or simultaneous manner in a specific order or in random manner, checking the openings before, during and after a transportation, loading and/or unloading process and using the loading and/or unloading-relevant data as those concerning the filling type, filling quantity, manufacturer, filler, consignee, temperature, tank number, empty state, residual volume, route, and/or driver.

4. A security system for flowable products in storage and/or transportation tanks, which have openings at least for filling, removal and/or control purposes, said system, having at least one control device and a write-read device for data exchange with connection elements connectable to the particular opening, comprising:

a tag associated with each said opening, a closure element associated with each opening as a connection element and on which is located the tag associated with the opening, the association of tag and opening can be controlled and stored in the control device and when there is a specific association of all the tags with the given openings a manipulation-free state can be displayed by the control device.

5. The security system according to claim 4, wherein the control device for generating, storing and/or displaying a "SEALED" signal if within a given time interval following a correct filling indicated by the filling data all the data read by the write-read devices coincide with the correct association of tags with the openings and for generating, storing and/or displaying an "UNSEALED" signal if data cannot be read by the write-read devices or read data do not coincide with the correct association of the tags with the openings.

6. The security system according to claim 4, wherein on all said openings of the storage or transportation tank, on which at least potentially a manipulation could take place, are provided write-read devices and corresponding closure elements with associated tags and that the write-read devices are constructed as substantially identical write-read pencil or tag readers.

7. The security system according to claim 4, wherein the control device is constructed for receiving data of the tags via tag readers and for receiving data of optionally connected hoses or tubes and/or from measuring sensors for recording, time logging, evaluating and/or display.

8. The security system according to claim 4, wherein the control device is constructed by means of the tag readers for the data exchange of loading and/or unloading-relevant data such as e.g. product quality, quantity, temperature, etc., before, during and after loading and unloading processes with a loading or unloading station or the like.

9. The security system according to claim 4, wherein loading and/or unloading-relevant data are preset in the control device, an enable signal for loading and/or unloading can only be generated by the control device if the preset data are compatible with the exchanged data with a loading and/or unloading station, an authorization device being provided making it possible to read authorization data into the control device, and the control device can enable or inhibit a modification of data stored in the control device, a discharge or filling release, on the basis of the authorization data.

10. The security system according to claim 4, wherein the control device is constructed for the continuous, repeated and sequential, particularly randomized, and/or parallel reading out of all the tag readers and that reading out takes place by means of a readout cycle generated and emitted by a timer.

11. The security system according to claim 4, wherein the data can be transmitted between the write-read device and a tag by means of electromagnetic waves, magnetic induction, optically, infrared radiation, acoustically or ultrasonically.

12. The security system according to claim 4, wherein the tag is constructed as a transponder, transponder simulator or transponder emulator.

13. The security system according to claim 4, wherein the data are exchangeable in wireless or on-wire manner between the tag readers and control device, by means of a serial or parallel bus data line.

14. The security system according to claim 4, wherein at least one measuring sensor is provided through which filling data, loading or unloading-relevant data of the storage and transportation tank, such as data concerning the fill level, nature of the filling, and/or temperature, can be recorded and transmitted to the control device.

15. The security system according to claim 4, wherein the tag is activatable at least by a tag reader, for providing an identification signal characteristic of the closure.

16. The security system according to claim 4, wherein at least one discharge and/or feed valve controllable by the control device is provided on the storage or transportation tank.

17. The security system according to claim 4, wherein for data exchange the control device is constructed with an external control device of a filling or unloading station and that the data exchange takes place by means of hoses or tubes connected to the openings, by an inductive coupler means, or a wireless or on-wire data transmission section.

18. A method for securing a flowable product in a storage and/or transportation tank, in which a control device and a write-read device are used for data exchange with connection elements connectable to the particular opening and which have a code mark or tag, with the following steps:

determining an actual filling state of the storage and transportation tank with respect to the quantity and the quality of the flowable product;

storing data with respect to the quantity and the quality of the flowable product and/or unloading-relevant data;

associating closure elements and tags with openings of the storage or transportation tank and coding the association;

closing with the closure element associated with the particular opening;

using the tag data read out with the write-read device;

checking whether the openings of the storage or transportation tank are correctly closed;

generating, storing and/or displaying an "UNSEALED" signal, if at least one opening is incorrectly closed or left open with the associated closure element; and generating, storing and/or displaying a "SEALED" signal if in the existence of a predetermined filling state of the storage or transportation tank all the openings have been correctly closed within a predetermined time interval with the associated closure element and if the actual filling state coincides with the predetermined filling state.

19. The method according to claim 18, comprising the steps of:

checking the openings of the storage and transportation tank are repeatedly in a successive and/or simultaneous manner, in a specific order, or in random manner;

checking the openings before, during and after a transportation, loading and/or unloading process; and using loading and/or unloading-relevant data as those concerning the filling type, filling quantity, manufacturer, filler, consignee, temperature, tank number, empty state, residual volume, route, and/or driver.

20. A method for securing a flowable product in a storage and/or transportation tank, in which a control device and a write-read device are used for data exchange with connection elements connectable to the particular opening and which have a code mark or tag, with the following steps:

storing data with respect to the quantity and quality of the flowable product and/or unloading-relevant data;

associating closure elements and tags with openings of the storage or transportation tank and coding the association;

repeatedly checking in a successive and/or simultaneous manner in a specific order or in random manner whether the openings of the storage or transportation tank are correctly closed and closed with the closure element associated with the particular opening, use being made of the tag data read out with the write-read device, wherein the opening are checked before, during and after a transportation, loading and/or unloading process;

generating, storing and/or displaying an "UNSEALED" signal, if at least one opening is incorrectly closed or left opened with the associated closure element; and generating, storing and/or displaying a "SEALED" signal if in the existence of a predetermined filling state of the storage or transportation tank all the openings have been correctly closed within a predetermined time interval with the associated closure element.

21. The method according to claim 20, comprising the steps of:

determining the actual filling state of the storage and transportation tank with respect to the quantity and quality of the flowable product;

comparing the actual filling state with the predetermined filling state; and generating a "SEALED" signal only if the actual filling state coincides with the predetermined filling state.

22. A security system for flowable products in storage and/or transportation tanks, which have openings at least for filling, removal and/or control purposes, having at least one control device and a write-read device for data exchange with connection elements connectable to the particular opening comprising:

a tag associated with each opening;

a closure element, with each opening, is associated as a connection element and on which is located the tag associated with the opening;

the association of tag and opening can be controlled and stored in the control device; and the control device for generating, storing and/or displaying a "SEALED" signal if within a given time interval following a correct filling indicated by the filling data all the data read by the write-read devices coincide with the correct association of tags with the openings, and for generating, storing and/or displaying an "UNSEALED" signal if data cannot be read by the write-read devices or read data do not coincide with the correct association of the tags with the openings.

23. The security system according to claim 22, wherein loading and/or unloading-relevant data are preset in the control device;

an enable signal for loading and/or unloading being generated only by the control device if the preset data are compatible with the exchanged data with a loading and/or unloading station;

an authorization device for making it possible to read authorization data into the control device; and the control device enabling or inhibiting a modification of data stored in the control device, particularly a discharge or filling release, on the basis of the authorization data.

24. The security system according to claim 22, wherein the control device is constructed for the continuous, repeated and sequential, particularly randomized, and/or parallel reading out of all the tag readers and that reading out takes place by means of a readout cycle generated and emitted by a timer.

* * * * *